US011515680B2

(12) United States Patent
Ivanov et al.

(10) Patent No.: US 11,515,680 B2
(45) Date of Patent: Nov. 29, 2022

(54) CONTACT RING AND CONTACT SYSTEM

(71) Applicant: TE Connectivity Germany GmbH, Bensheim (DE)

(72) Inventors: Ivan Ivanov, Bensheim (DE); Michael Burghard, Bensheim (DE); Helge Schmidt, Speyer (DE); Hubert Pollok, Darmstadt (DE); Sönke Sachs, Bensheim (DE); Marco Wolf, Speyer (DE); Christoph Kosmalski, Bensheim (DE); Martin Listing, Bensheim (DE); Uemit Bulduk, Bensheim (DE); Jochen Fertig, Bensheim (DE); Willi Dietrich, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/245,720

(22) Filed: Apr. 30, 2021

(65) Prior Publication Data

US 2021/0344153 A1 Nov. 4, 2021

(30) Foreign Application Priority Data

Apr. 30, 2020 (DE) ..... 102020205548.3
Aug. 19, 2020 (DE) ..... 102020210534.0

(51) Int. Cl.
*H01R 39/12* (2006.01)
*H01R 39/34* (2006.01)

(52) U.S. Cl.
CPC ..... *H01R 39/12* (2013.01); *H01R 39/34* (2013.01)

(58) Field of Classification Search
CPC . H01R 4/26; H01R 4/28; H01R 39/12; H01R 39/34
USPC ..... 439/883
See application file for complete search history.

(56) References Cited

U.S. PATENT DOCUMENTS 6,406,330 B2 * 6/2002 Bruce ..... H01R 13/6277 439/862
7,587,244 B2 * 9/2009 Olbertz ..... A61N 1/3752 607/37
8,303,357 B2 * 11/2012 Kuwahara ..... H01M 50/502 439/444
10,103,468 B2 * 10/2018 Kovalov ..... H01R 13/03
(Continued)

FOREIGN PATENT DOCUMENTS

GB 1514502 A 6/1978
JP 2012009411 A 1/2012

OTHER PUBLICATIONS

European Patent Office Extended European Search Report, App. No. 21170828.4-1201,dated Oct. 5, 2021, 11 pages.
(Continued)

*Primary Examiner* — Oscar C Jimenez
*Assistant Examiner* — Paul D Baillargeon
(74) *Attorney, Agent, or Firm* — Barley Snyder

(57) ABSTRACT

A contact system comprises a ground cylinder, a shielding cylinder press-fit with the ground cylinder, and a contact ring disposed between the ground cylinder and the shielding cylinder. The contact ring includes a strip of electrically conductive material defining a plurality of projections on at least one longitudinal side. The projections electrically contact the ground cylinder and the shielding cylinder for establishing an electrically conductive connection therebetween.

20 Claims, 16 Drawing Sheets

(56) References Cited

U.S. PATENT DOCUMENTS

| | | | |
|---|---|---|---|
| 2011/0287644 | A1 | 11/2011 | Kuwahara et al. |
| 2015/0099397 | A1 | 4/2015 | Listing et al. |

OTHER PUBLICATIONS

Sonya Zhang, Neal Cabage, Search Engine Optimization: Comparison of Link Building and Social Sharing, Journal of Computer Information Systems, 2017, vol. 57, No. 2, pp. 148-159.

* cited by examiner

CONTACT RING AND CONTACT SYSTEM

CROSS-REFERENCE TO RELATED APPLICATIONS

This application claims priority under 35 U.S.C. § 119 to German Patent Application No. DE 102020205548.3 filed on Apr. 30, 2020, and German Patent Application No. DE 102020210534.0 filed on Aug. 19, 2020, the entire disclosures of which are incorporated herein by reference.

FIELD OF THE INVENTION

The present disclosure relates to an electrically conductive contact ring, and more specifically, to a contact ring for electrically connecting a ground cylinder to a shielding cylinder.

BACKGROUND

FIGS. 1A and 1B illustrate conventional arrangements of two contact elements 1 and 2 secured together without the use of a connecting member (FIG. 1A), and with a connecting member 3 (FIG. 1B). Referring to FIG. 1A, although comprised of electrically conductive materials, due to resulting natural oxides formed on their surfaces, for example, contact elements 1 and 2 cannot be directly connected in a reliably electrically conductive manner. In addition, the contact elements are not configured to avoid the presence of air gaps therebetween, reducing the efficiency of any electromagnetic shielding of such a direct connection.

In order to address the above deficiencies, a connecting member made of an electrically conductive material may be used between the contact elements for establishing an electrically conductive connection therebetween. Specifically, connecting member 3 of FIG. 1B takes the form of a compressible contact ring 3. In the known embodiment, contact ring 3 is flat and wave-shaped, alternately touching the surfaces of the contact elements, and is typically made of spring steel which has good mechanical properties, but poor electrothermal performance. Due in part to their generally flat nature, contacting sections of contact ring 3 are not able to reliably penetrate electrically insulating surface layers formed on contact elements 1 and 2, such as aluminum oxide. Further, these contact rings 3 are also prone to corrosion.

Accordingly, there is a need for connecting members that provide improved electrically conductive connections between adjoining contact elements, including contact elements having electrically insulating surface layers.

SUMMARY

According to an embodiment of the present disclosure, a contact system comprises a ground cylinder, a shielding cylinder press-fit with the ground cylinder, and a contact ring disposed between the ground cylinder and the shielding cylinder. The contact ring includes a strip of electrically conductive material defining a plurality of projections on at least one longitudinal side thereof. The projections electrically contact the ground cylinder and the shielding cylinder for establishing an electrically conductive connection therebetween.

BRIEF DESCRIPTION OF THE DRAWINGS

The invention will now be described by way of example with reference to the accompanying Figures, of which.

DETAILED DESCRIPTION OF THE EMBODIMENTS

Figure 1A:
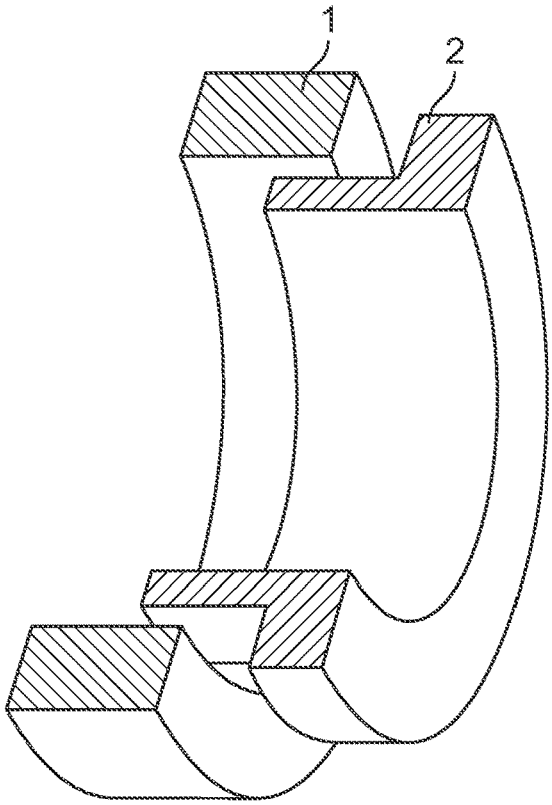
FIG. 1A shows a representative first and a second contact element.
Figure 1B:
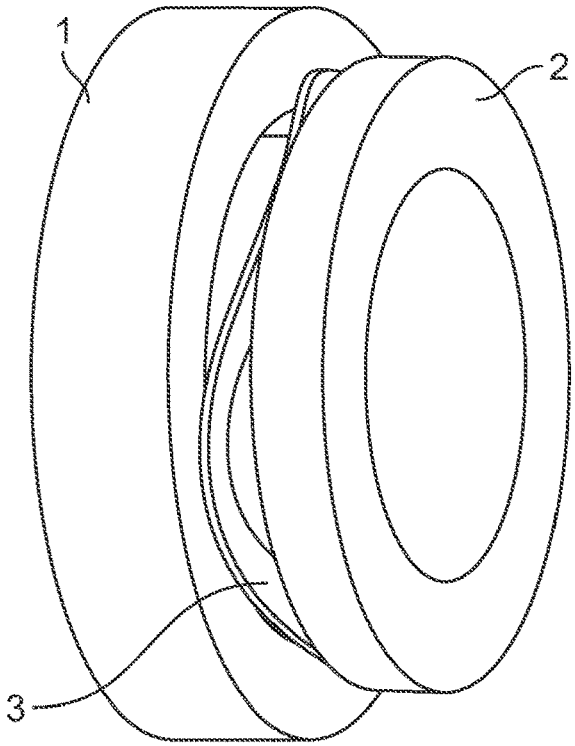
FIG. 1B shows the two contact elements of FIG. 1A connected by a contact ring according to the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present invention shall be described hereafter in detail with reference to FIGS. 2A to 13D.

Figure 2A:
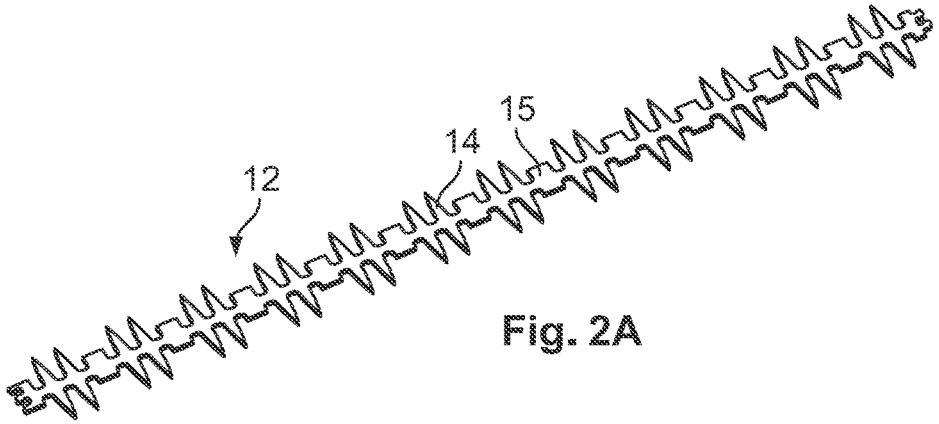
FIG. 2A shows a strip according to the first embodiment of the present invention.
Figure 2B:
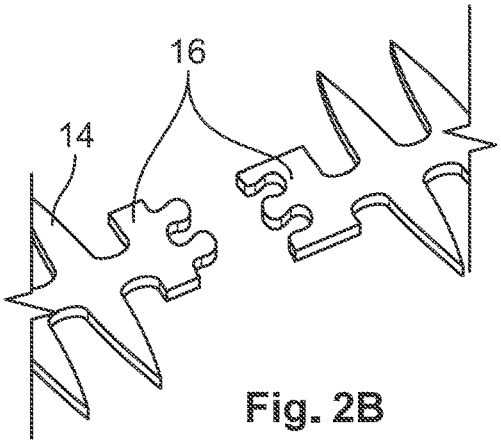
FIG. 2B shows an optional closure according to the first embodiment of the present invention.
Figure 2C:
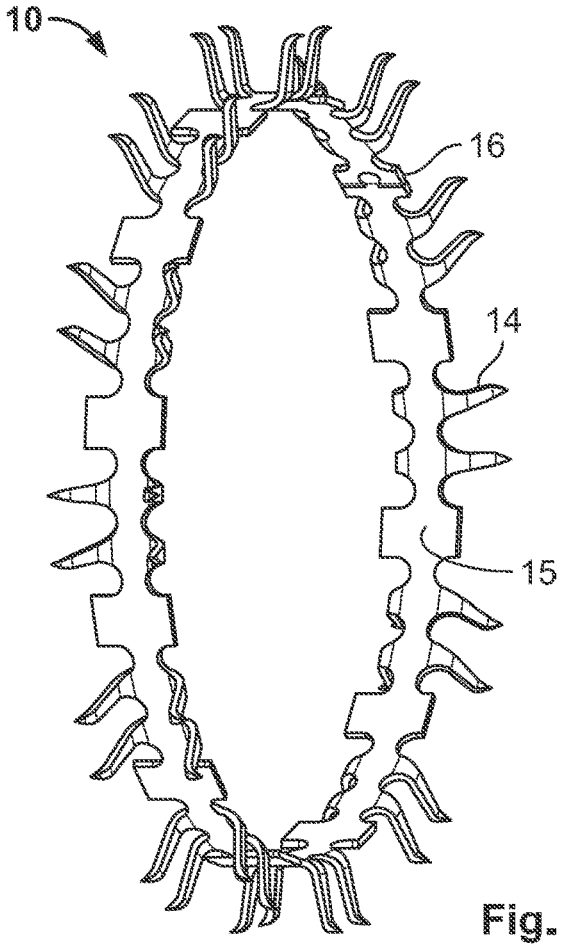
FIG. 2C shows a contact ring according to the first embodiment of the present invention.

FIGS. 2A to 2C show a contact ring 10 according to a first embodiment of the present invention. As shown in FIG. 2A, contact ring 10 comprises a strip 12 made of electrically conductive material. Strip 12 is provided with projections 14 on at least one longitudinal side. Projections 14 taper and form a tip at their end. FIG. 2B shows that strip 12 can include ends each defining a closure 16 which allows strip 12 to be closed to form a ring-shaped cylindrically arranged structure, as can be seen in FIG. 2C. This structure allows for simple and inexpensive production of contact ring 10 by punching and bending. As shown in FIG. 2C, projections 14 are bent outwardly and have an S-shaped cross section.

A coil spring (not shown) can optionally surround contact ring 10 concentrically so that the connection between contact ring 10 and cylindrical contact element 2 is even more stable. In addition, it is also possible for the strip to be open at the ends without a closure. In this case, the coil spring can optionally hold the strip together. In another embodiment, the strip may be formed longer than a circumference of a related contact element, so as to overlapping ends.

The material of contact ring 10 preferably comprises a copper alloy which can be silver-plated. In contrast to the spring steel used in prior art embodiments, this material has good mechanical as well as good electrothermal properties.

Figure 3:
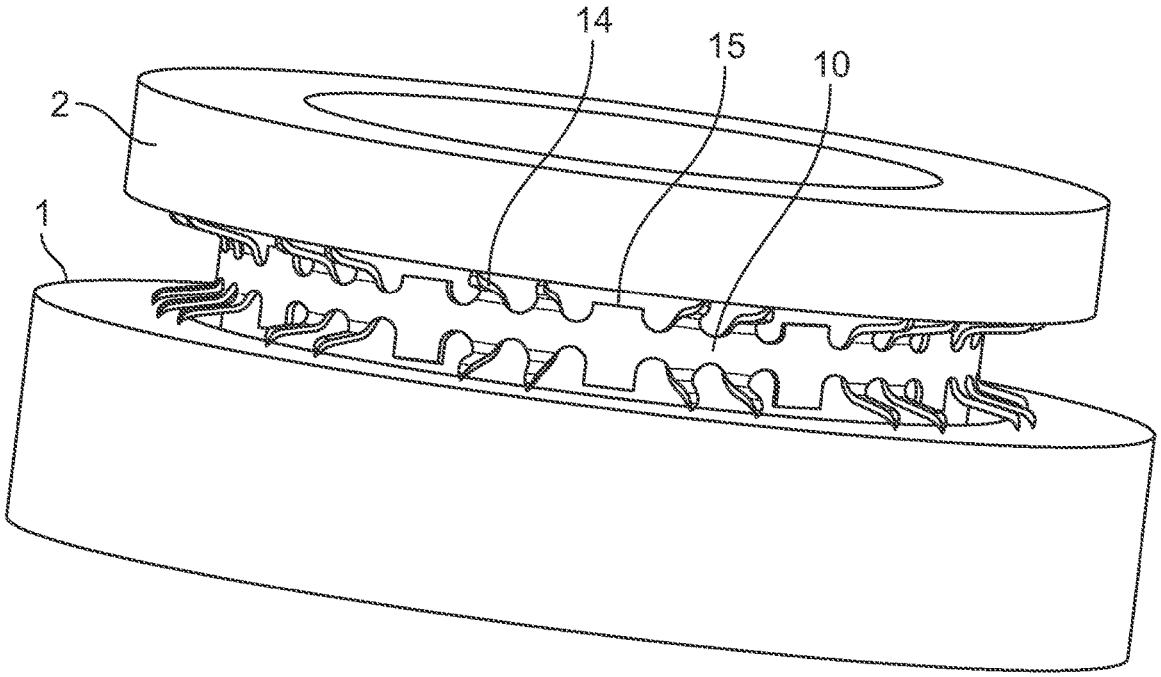
FIG. 3 shows the configuration of two contact elements and the contact ring according to the first embodiment of the present invention.

FIG. 3 shows an exemplary application of contact ring 10. Contact ring 10 is arranged between two contact elements 1 and 2 such that it touches the oppositely disposed surfaces of contact elements 1 and 2 with the tips of S-shaped projections 14. As contact elements 1 and 2 are pressed against one another, the tips of projections 14 penetrate electrically insulating surface layers, such as a layer of aluminum oxide which naturally forms on the surface of a contact element made of electrically conductive aluminum. An electrically conductive connection can thus be established with the aid of contact ring 10 between the electrically conductive core of first contact element 1 and the electrically conductive core of second contact element 2, even if contact elements 1 and 2 comprise insulating surfaces that electrically separate them from one another. Further, a large number of projections 14, for example 24, as shown in FIG. 2C, on both sides of contact ring 10 has a positive effect on the electrothermal properties of the connection between the two contact elements 1 and 2. The structure of contact ring 10, with its pointed projections 14 touching contact elements 1 and 2, also minimizes the area of the contact sections in which a protective surface of contact elements 1 and 2 is damaged. Corrosion of contact elements 1 and 2 can thereby be counteracted.

Figure 4:
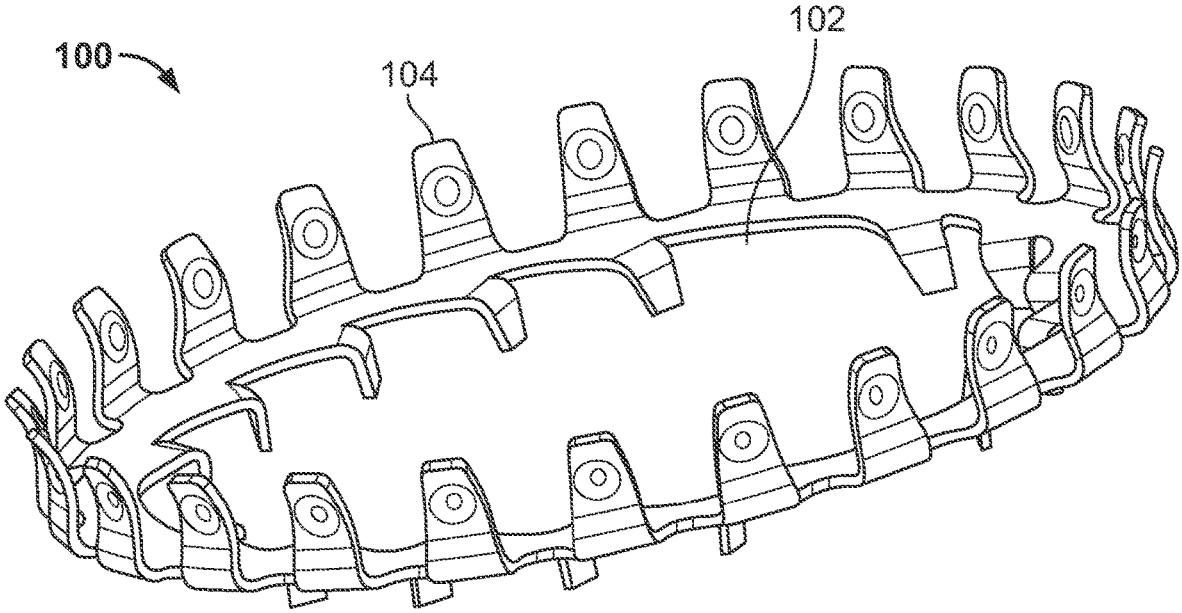
FIG. 4 shows a contact ring according to a second embodiment of the present invention.

FIG. 4 shows a contact ring 100 according to a second embodiment of the present invention. This contact ring 100 comprises a flat ring made of electrically conductive material. The flat ring is provided with projections 104 on the two narrow sides. Projections 104 taper towards their end. Projections 104 are bent such that they point out of the plane spanned by ring 100, with projections 104 on the outer side of ring 100 and projections 104 on the inner side of ring 100 pointing in opposite directions. Projections 104 are preferably, but not necessarily, arranged with regular spacing, where internal projections 104 can also have individual greater spacing.

Projections 104 on the outer side of ring 100 have an S-shaped cross section. They are oriented such that they surround a common inscribed circle that they touch with one flat side. Projections 104 on the inner side of ring 100 are oriented such that they each touch a common inscribed circle with an edge. This edge is sharp and therefore able to penetrate insulating surfaces. Projections 104 on the outer side of the ring can also optionally be oriented such that they each touch a common inscribed circle with an edge that is sharp and can therefore penetrate insulating surfaces. Like contact ring 10 according to the first embodiment, the material of contact ring 100 according to the second embodiment preferably comprises a copper alloy which can be silver-plated and which has good mechanical as well as good electrothermal properties. The structure of contact ring 100 can be created in a simple and inexpensive manner, such as a reel-to-reel strip formed by punching and bending.

Figure 5:
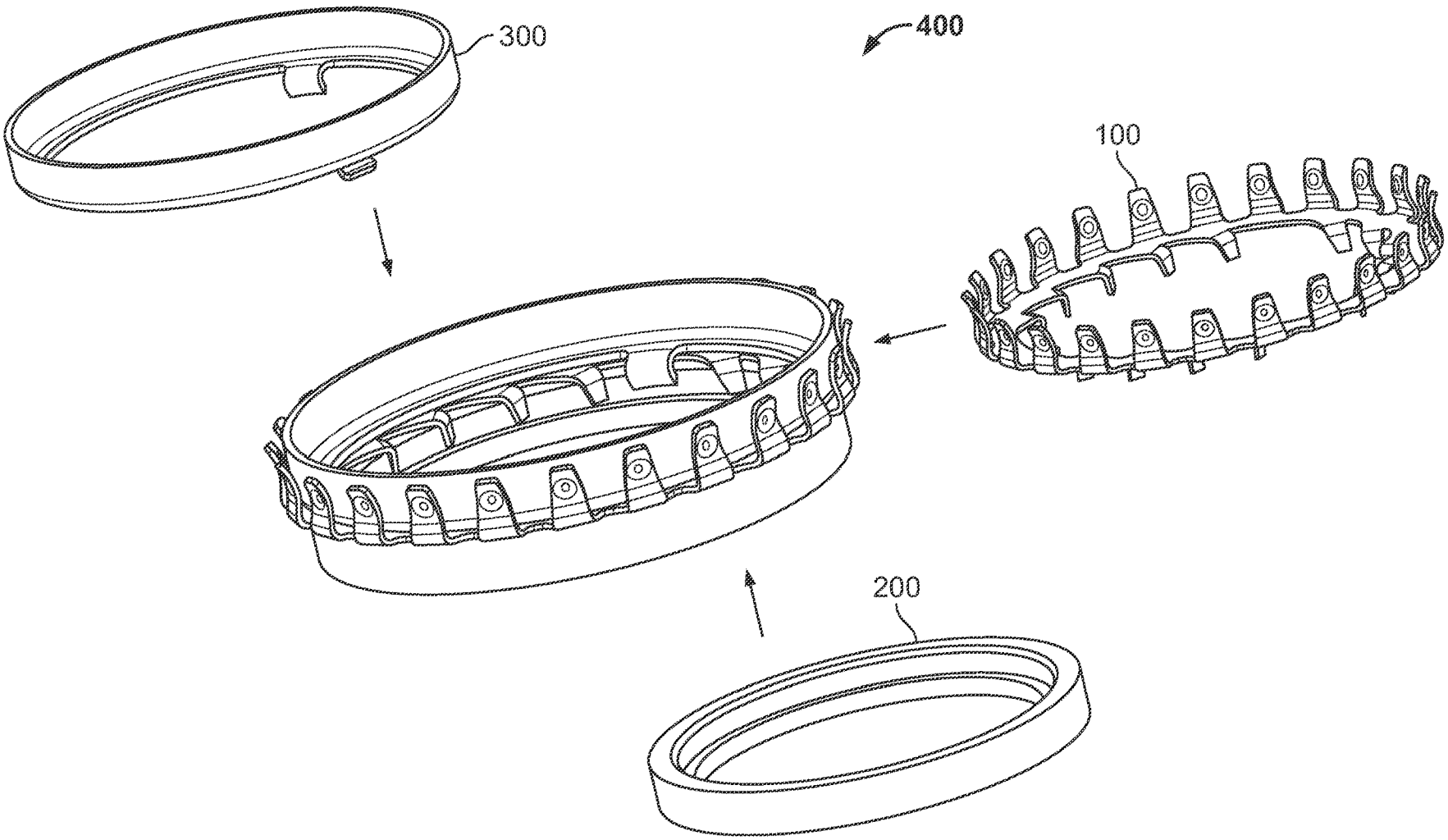
FIG. 5 shows the contact system comprising a contact ring according to the second embodiment, a ground cylinder, and a shielding cylinder according to the second embodiment of the present invention.

FIG. 5 shows the contact ring 100 according to the second embodiment arranged in a contact system 400 together with a ground cylinder 200 and a shielding cylinder 300. Projections 104 on the outer side of the ring engage around shielding cylinder 300. Projections 104 on the inner side of the ring are spread apart from the inside against ground cylinder 200. The connection is established by press-fitting, so that contact ring 100, ground cylinder 200, and shielding cylinder 300 contactor touch each other without any air gaps therebetween.

Figure 6A:
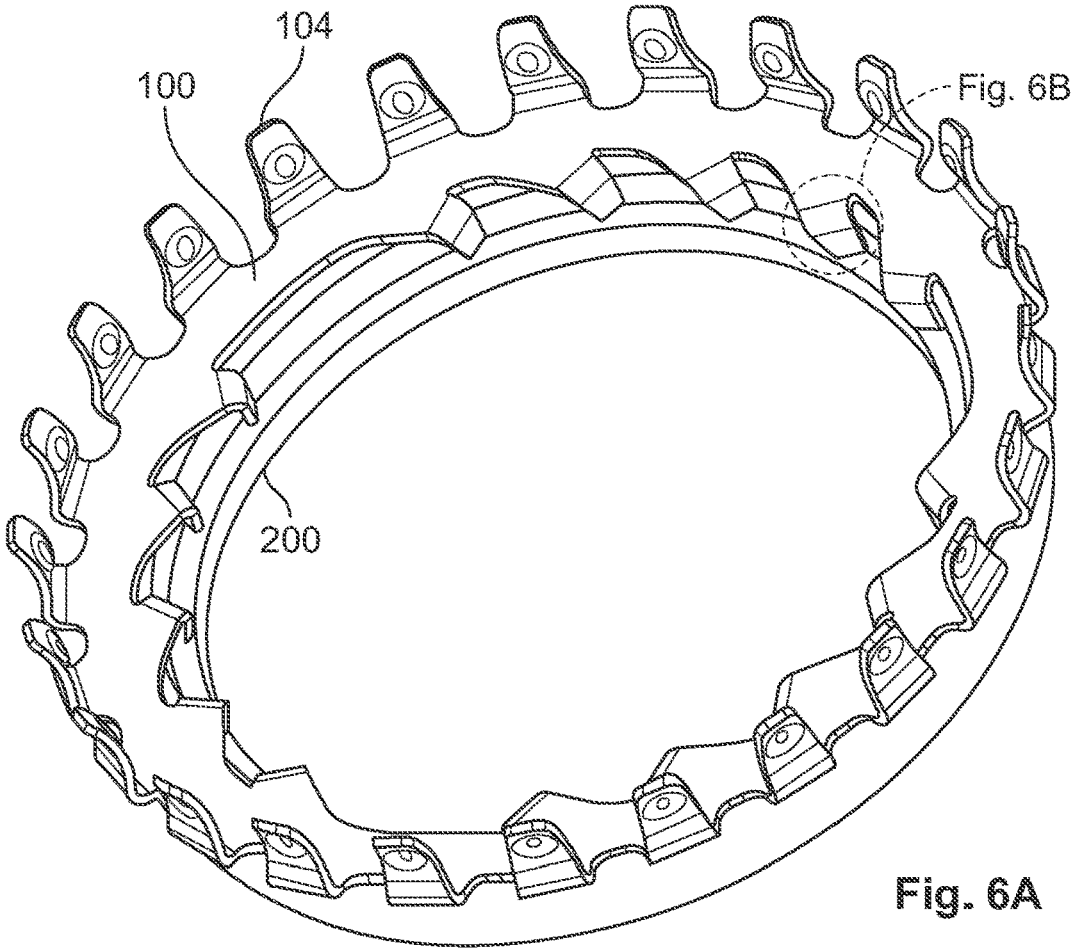
FIG. 6A shows the contact ring according to the second embodiment and the ground cylinder of the contact system.
Figure 6B:
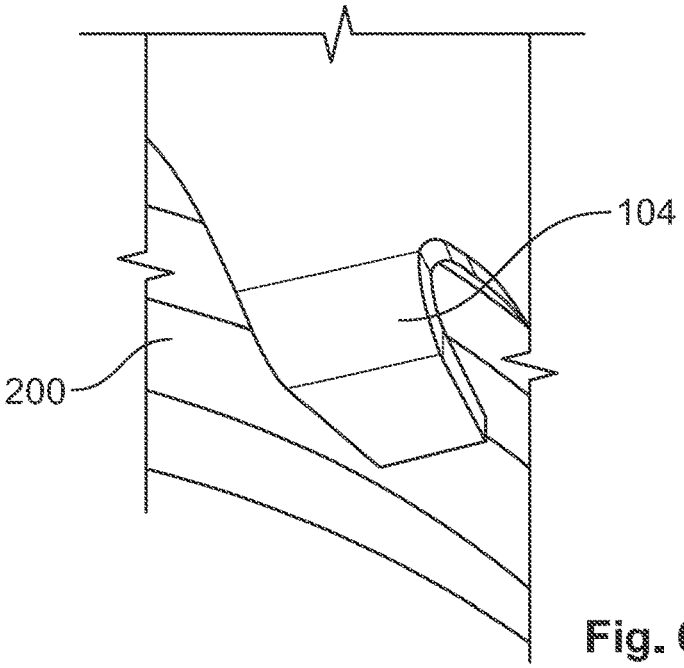
FIG. 6B shows a detail of the contact ring of the second embodiment and the ground cylinder of the contact system.

As shown in FIGS. 6A and 6B, contact ring 100 contacts ground cylinder 200 with a sharp edge of projections 104 on the inner side of the ring. As a result of the pressure of the press fit, the sharp edges penetrate the surface of ground cylinder 200. As described in relation to contact ring 10 according to the first embodiment, this creates an electrically conductive connection between contact ring 100 and the electrically conductive core of ground cylinder 200. Due to the expansion of the contact section between contact ring 100 and ground cylinder 200, corrosion is additionally reduced.

Figure 7A:
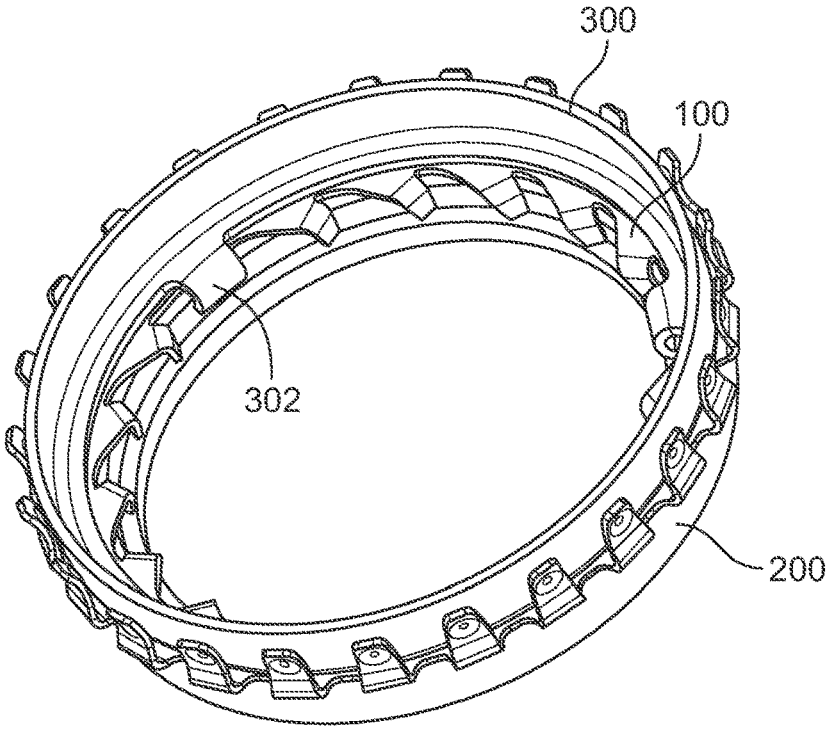
FIG. 7A shows the contact system comprising a shielding cylinder with centering projections according to the second embodiment of the present invention.
Figure 7B:
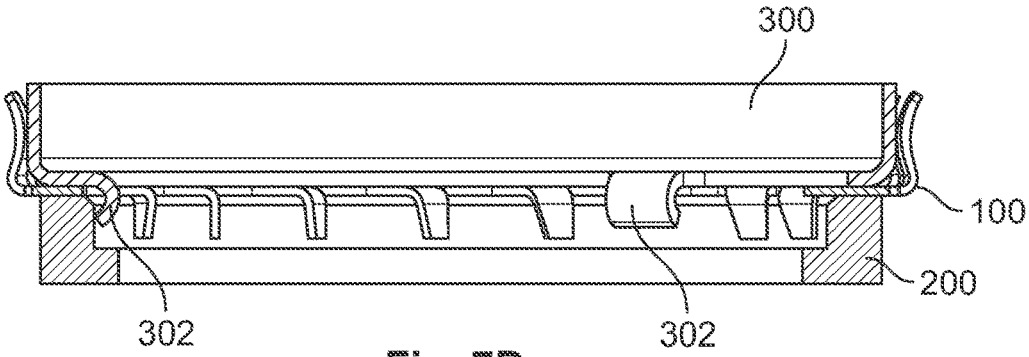
FIG. 7B shows a cross section of the contact system comprising a shielding cylinder with centering projections according to the second embodiment of the present invention.
Figure 7C:
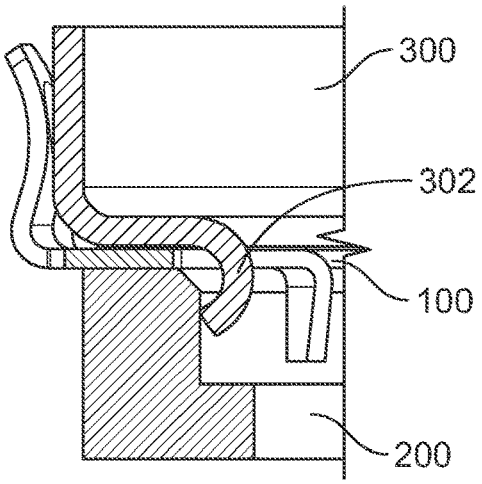
FIG. 7C shows an enlarged detail of the contact system comprising a shielding cylinder with a centering projection according to the second embodiment of the present invention.

As shown in FIGS. 7A to 7C, shielding cylinder 300 comprises three centering projections 302. Shielding cylinder 300 is connected to contact ring 100 in such a way that centering projections 302 are each positioned where contact ring 100 comprises internal projections 104 with greater spacing therebetween. As a result, centering projections 302 can be bent around contact ring 100 so that they touch ground cylinder 200 from the inside without being obstructed by a projection 104 of contact ring 100.

Centering projections 302 hold shielding cylinder 300 firmly to ground cylinder 200. As a result, they facilitate the centering of shielding cylinder 300 relative to ground cylinder 200 and stabilize contact system 400. Centering projections 302 and the press-fit of contact system 400 thereby ensure that the connection composed of contact ring 100, ground cylinder 200, and shielding cylinder 300 does not have any air gaps nor any relative motions and vibrations between the components. As a result, efficient electromagnetic shielding can be ensured, in particular in high frequency applications.

Figure 8:
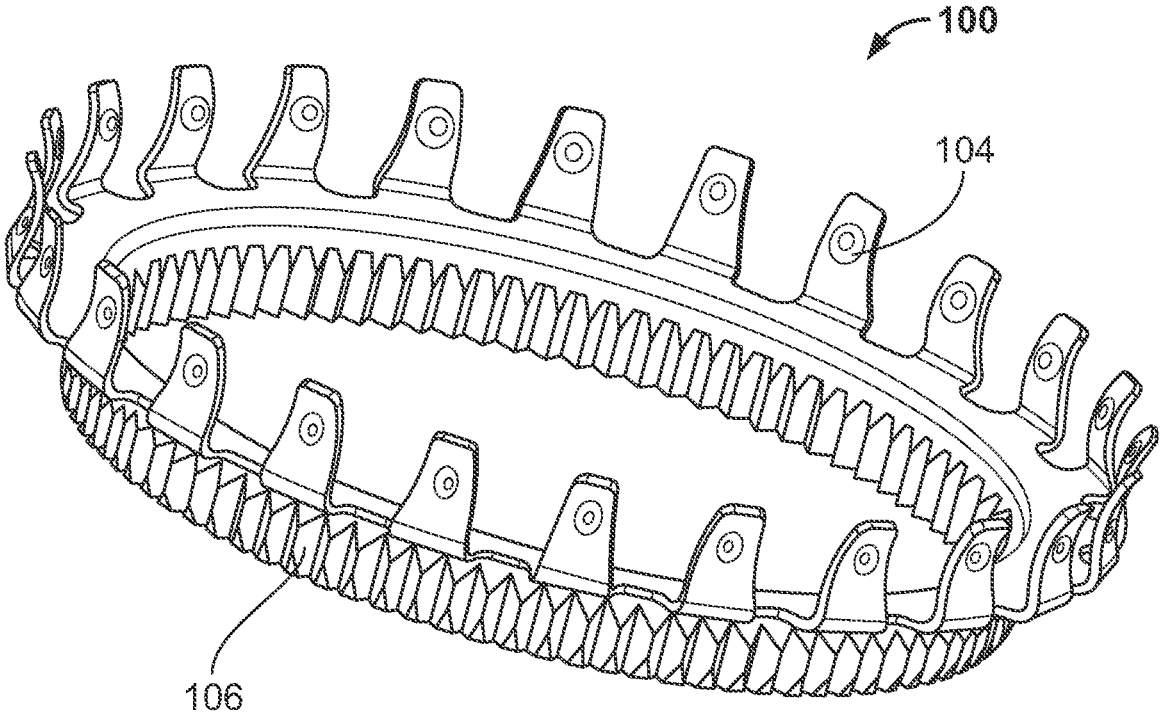
FIG. 8 shows the contact ring according to the second embodiment, alternatively with toothing instead of inner projections.

As shown in FIG. 8, contact ring 100 according to the second embodiment can alternatively comprise projections defining a toothing 106 instead of internal projections 104. This alternative of contact ring 100 according to the second embodiment can be produced in a simple and inexpensive manner by deep drawing, punching, and bending.

Figure 9A:
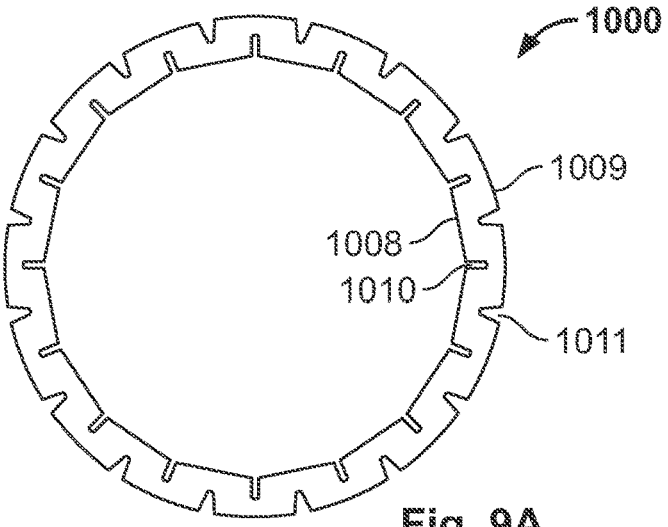
FIG. 9A shows the strip closed in a ring-shaped manner with a meander structure according to a third embodiment of the present invention.
Figure 9B:
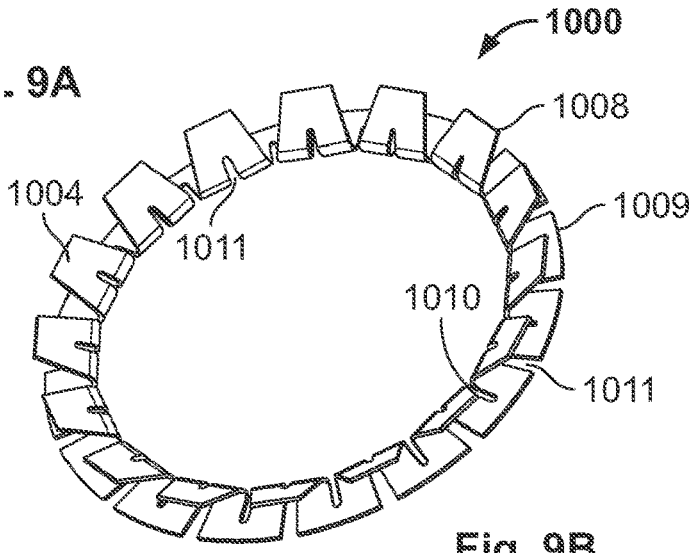
FIG. 9B shows the contact ring according to the third embodiment of the present invention with projections which point in the same direction.
Figure 9C:
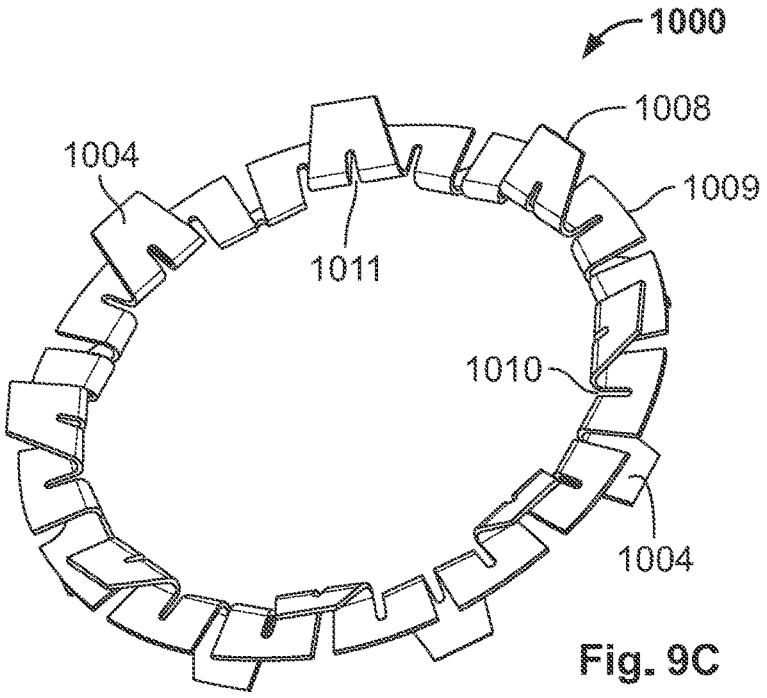
FIG. 9C shows the contact ring according to the third embodiment of the present invention with projections which point in different directions.

FIG. 9 shows a contact ring 1000 according to a third embodiment of the present invention. Like contact ring 100 of the second embodiment, contact ring 1000 consists of a strip which is closed to form a flat, ring-shaped structure. In addition, contact ring 1000 of the third embodiment has a meander structure or profile with sections alternately pointing inwardly 1008 and outwardly 1009. This arises from the strip being provided with cutouts 1010 and 1011 which alternately start out from the inner and outer edge of the strip and extend into the interior of the strip (see FIG. 9A). The meanders pointing inwardly are bent out of the plane of the ring and in this manner form projections 1004 for the electrically conductive contacting of the contact elements. Projections 1004 can point in the same direction, as shown in FIG. 9B, or in different directions, as shown in FIG. 9C.

Figure 10:
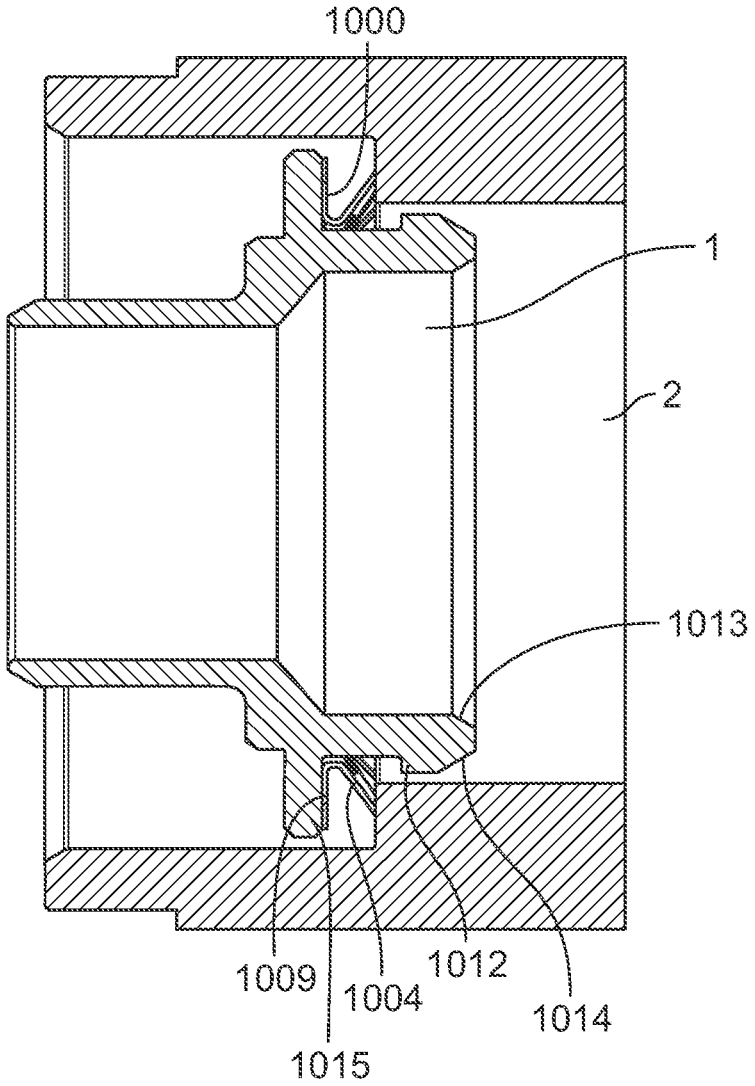
FIG. 10 shows a possible application of the contact ring according to the third embodiment.
Figure 11A:
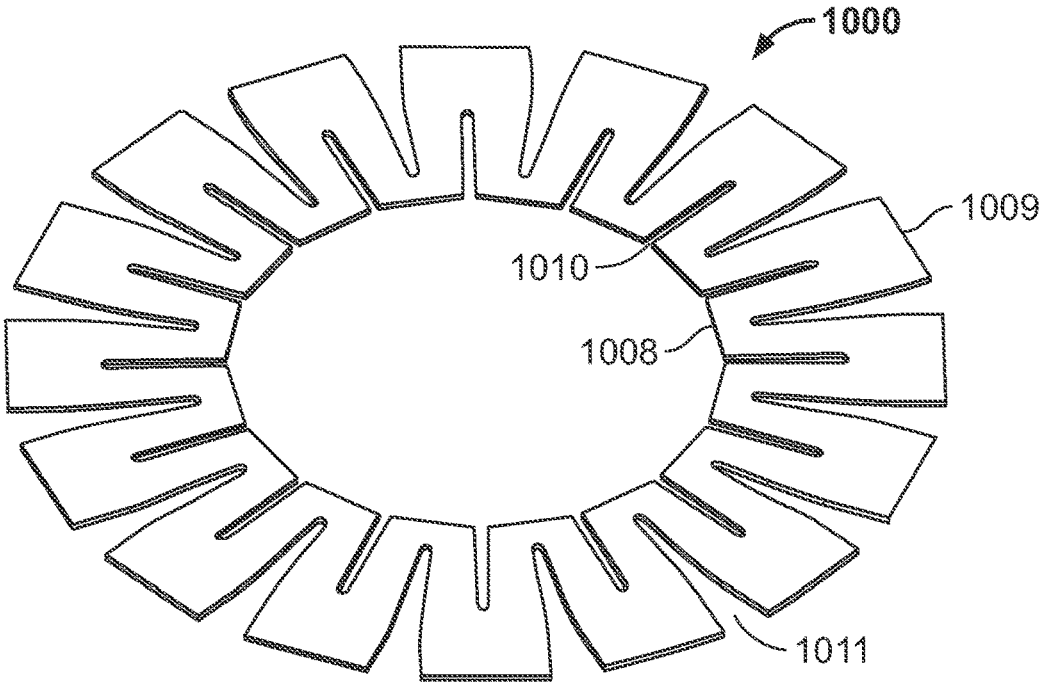
FIG. 11A shows the contact ring according to the third embodiment with attachment projections having a flat shape.
Figure 11B:
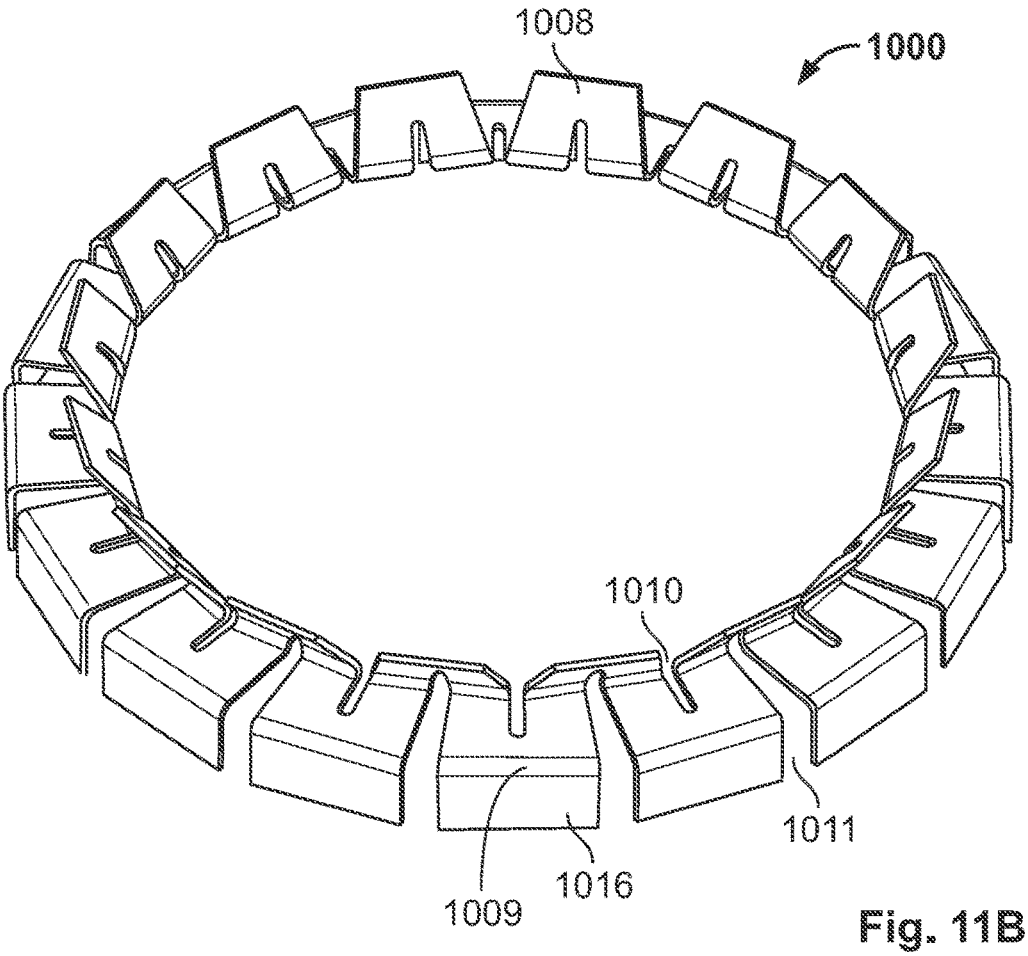
FIG. 11B shows the contact ring according to the third embodiment with attachment projections having bent-over projections.
Figure 11C:
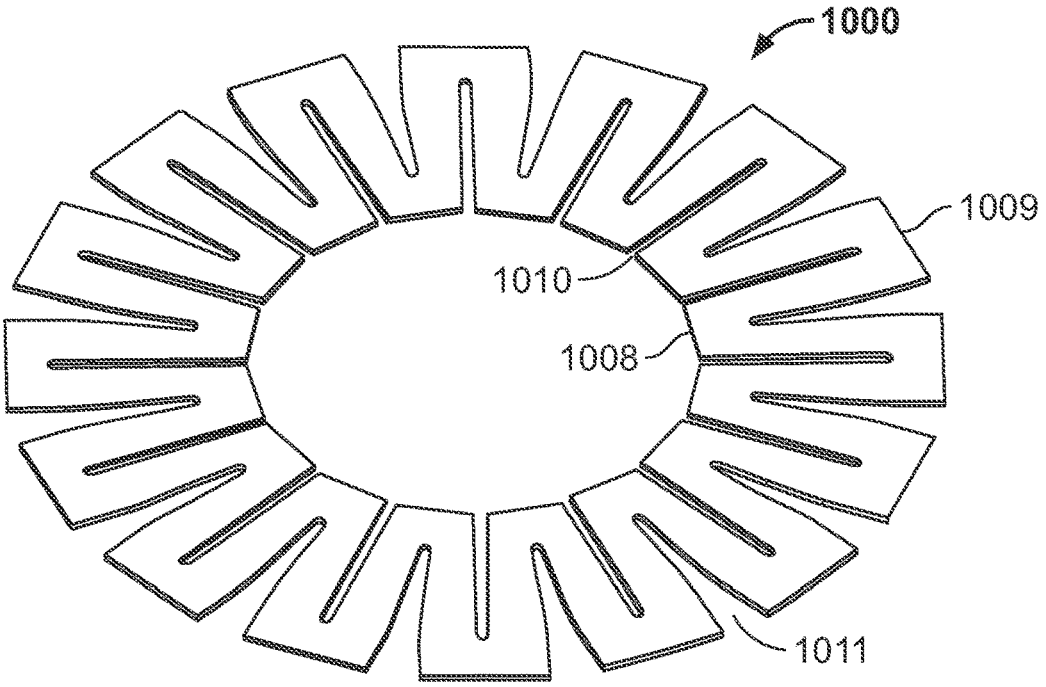
FIG. 11C shows the contact ring according to the third embodiment with attachment projections having a flat shape in a second variant.
Figure 11D:
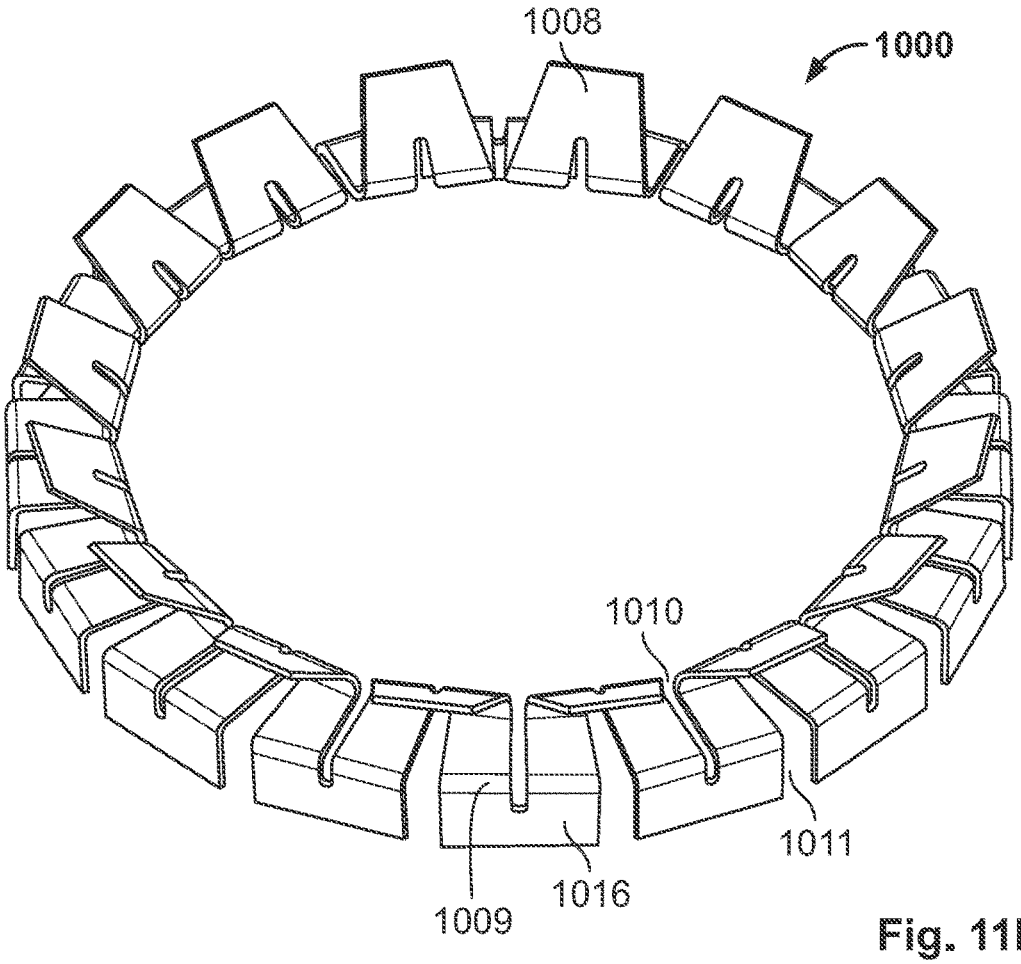
FIG. 11D shows the contact ring according to the third embodiment with attachment projections having bent-over projections in a second variant.
Figure 11E:
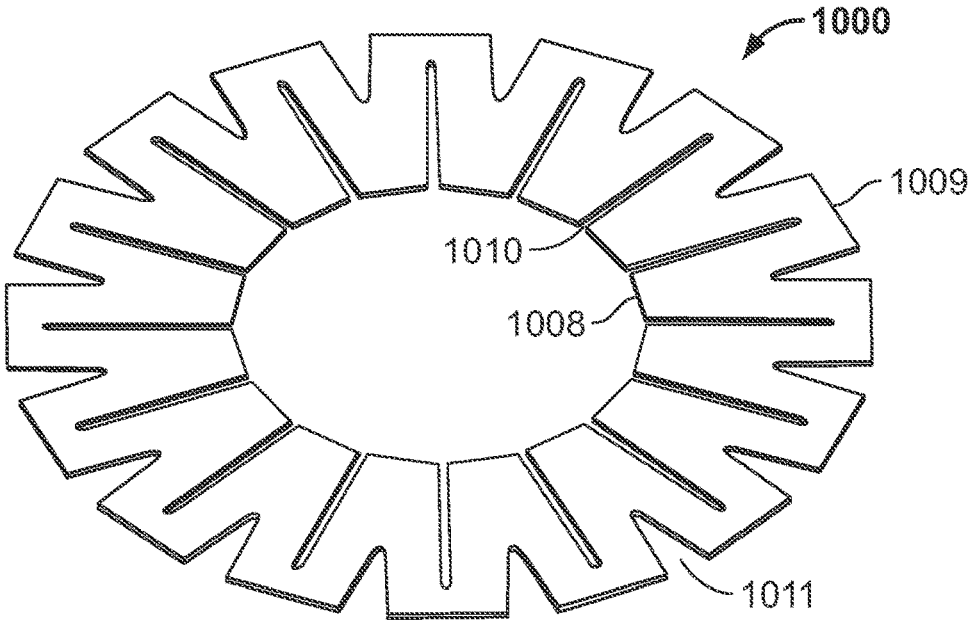
FIG. 11E shows the contact ring according to the third embodiment with attachment projections having a flat shape in a third variant.
Figure 11F:
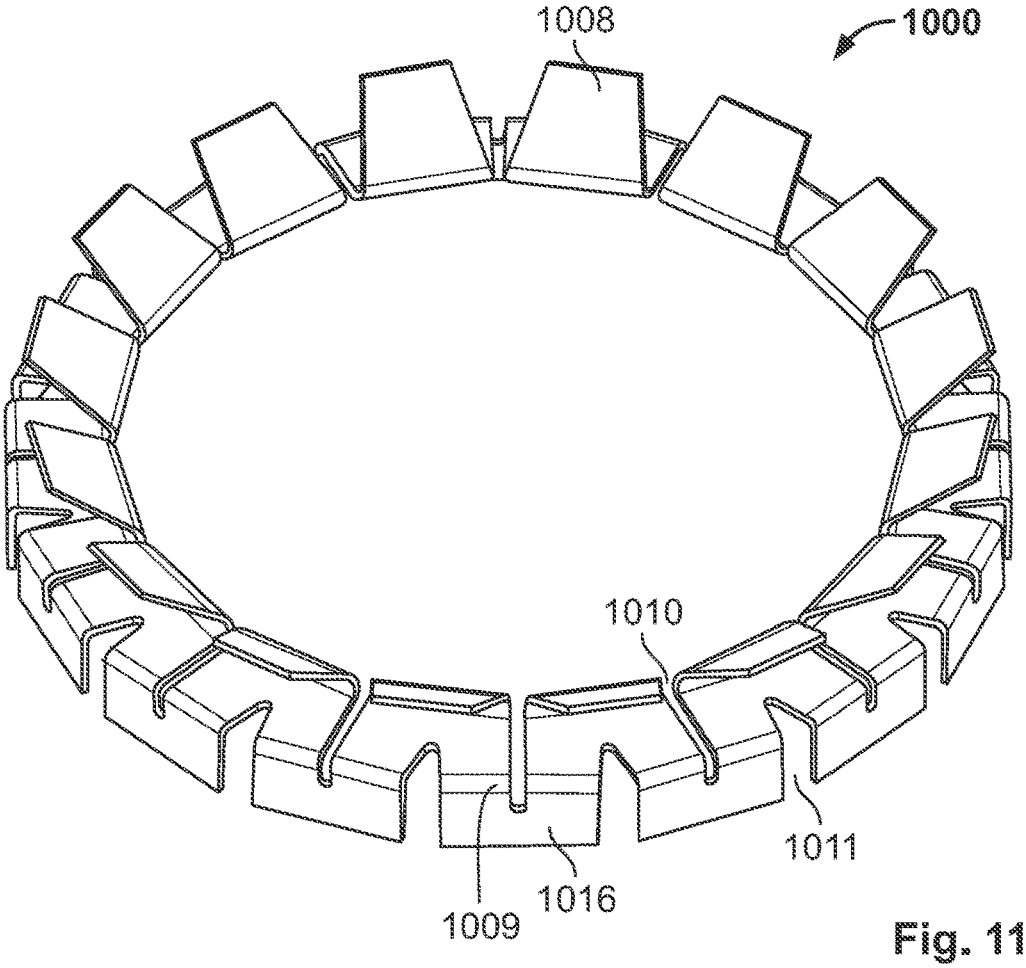
FIG. 11F shows the contact ring according to the third embodiment with attachment projections having bent-over projections in a third variant.
Figure 12A:
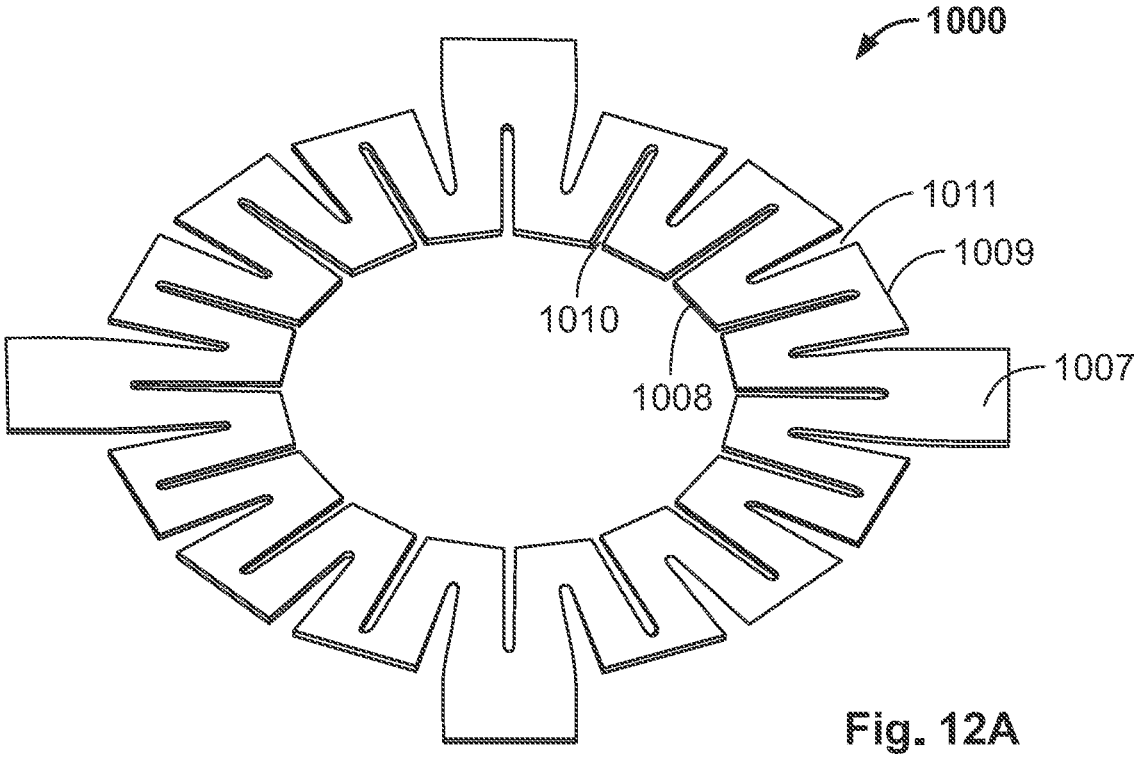
FIG. 12A shows the contact ring according to the third embodiment in an exemplary variation having a flat shape.
Figure 12B:
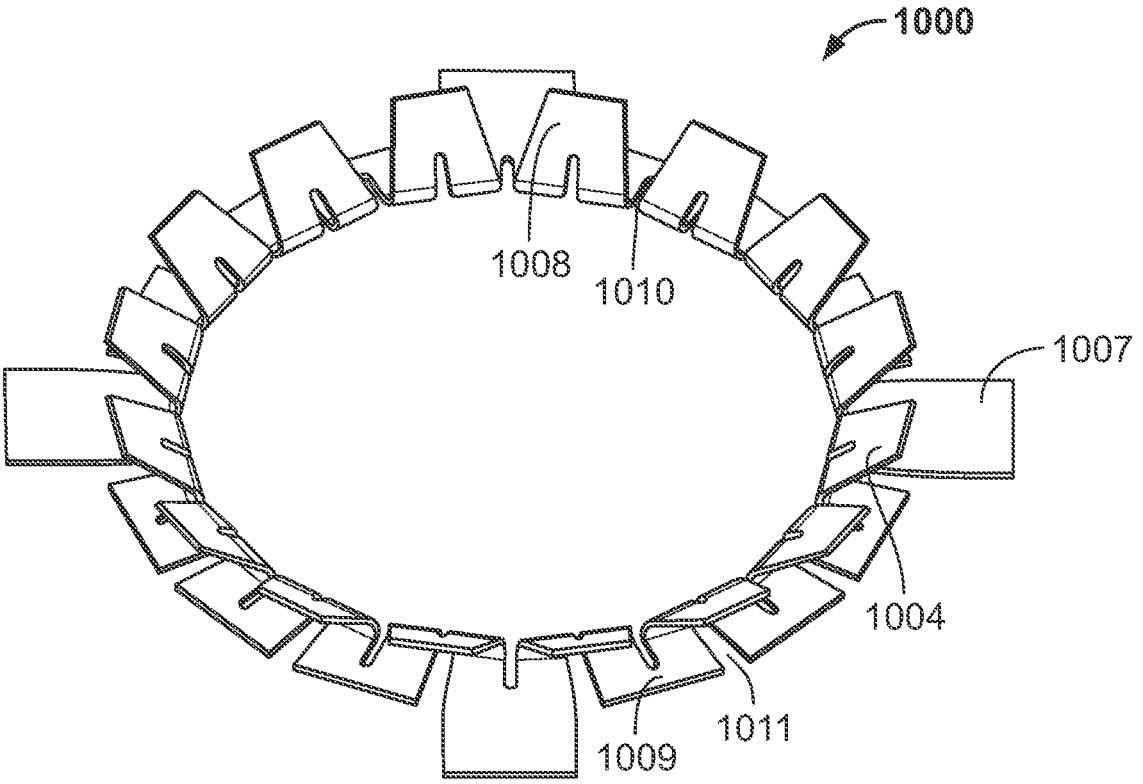
FIG. 12B shows the contact ring according to the third embodiment in an exemplary variation having bent-over projections.
Figure 12C:
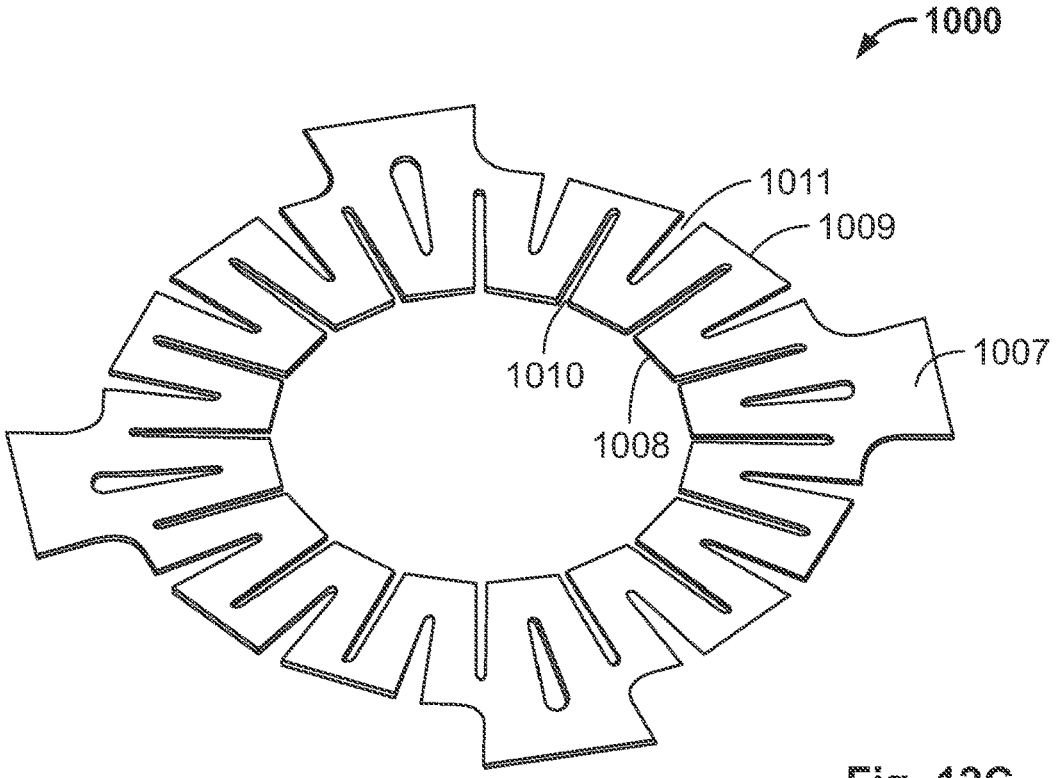
FIG. 12C shows the contact ring according to the third embodiment in a further exemplary variation having a flat shape.
Figure 12D:
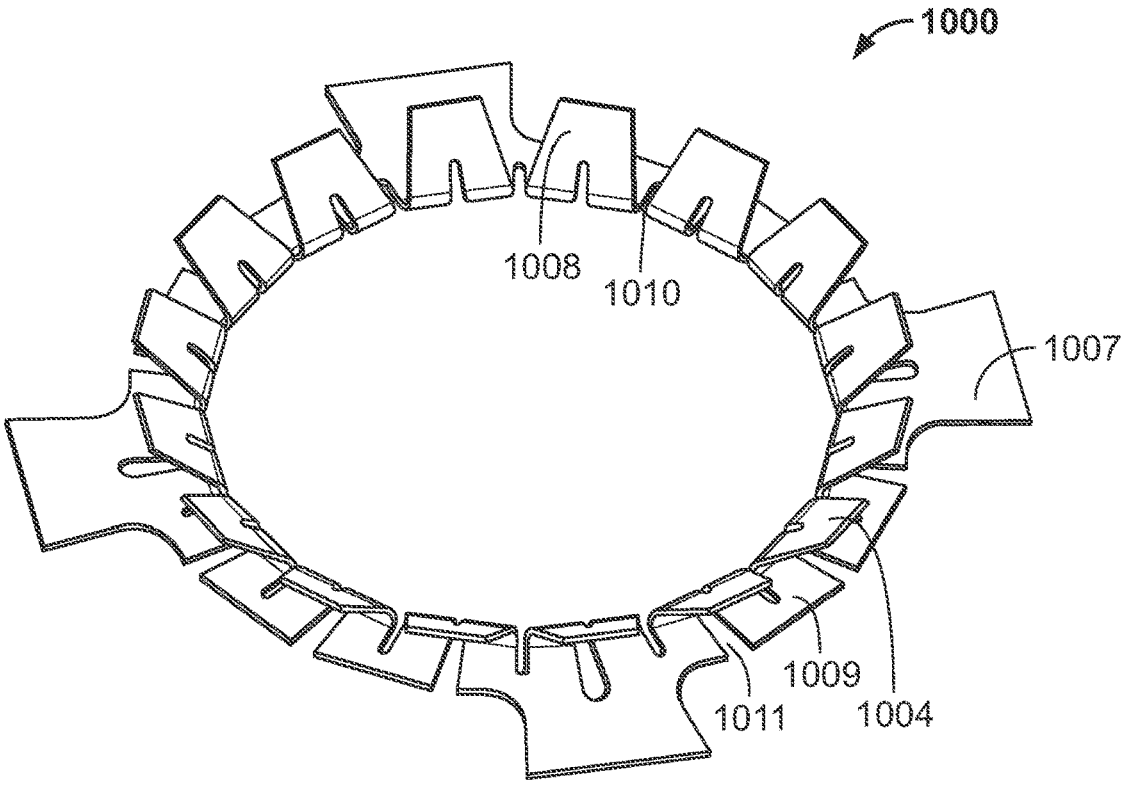
FIG. 12D shows the contact ring according to the third embodiment in a further exemplary variation having bent-over projections.
Figure 13A:
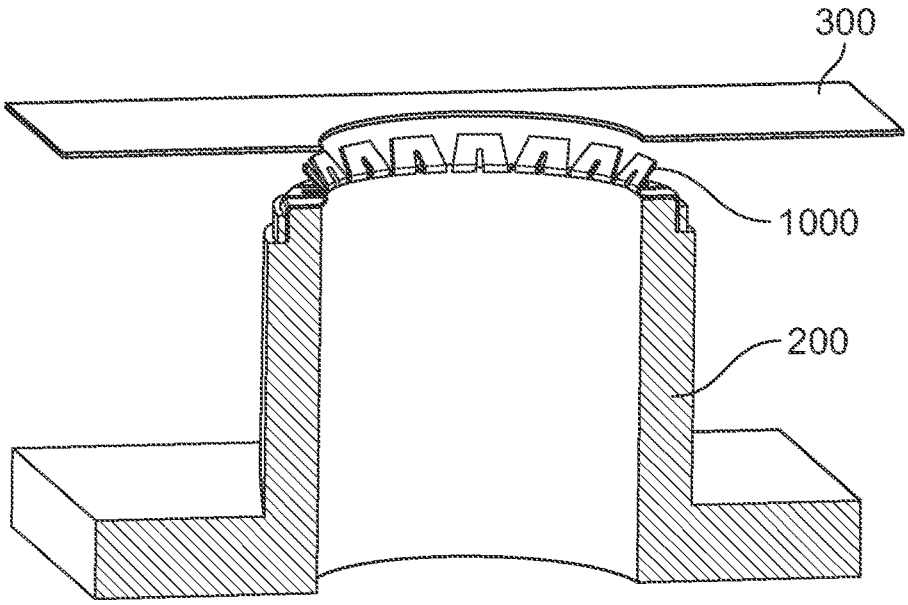
FIG. 13A shows the contact ring according to the third embodiment as part of a contact system in a first variant.
Figure 13B:
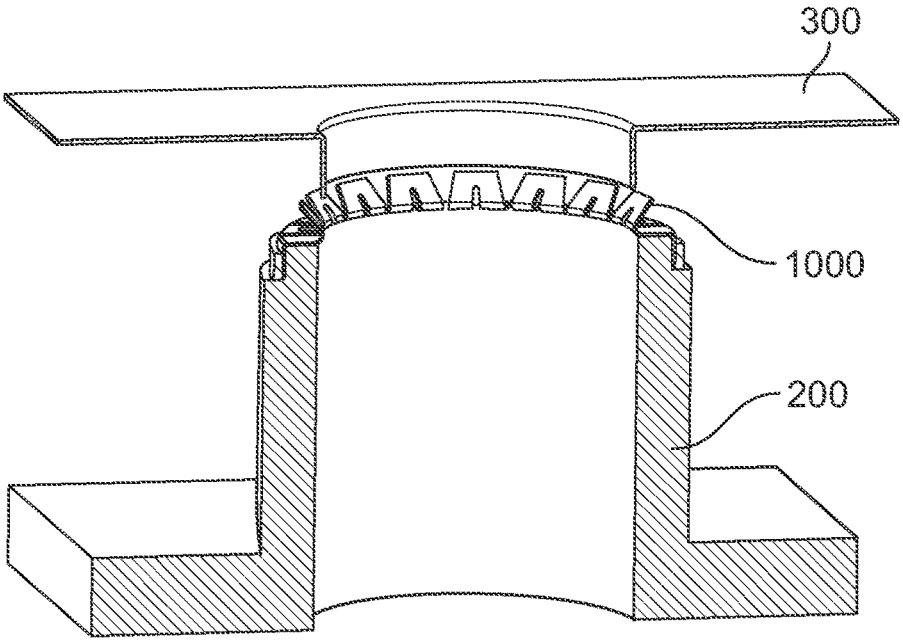
FIG. 13B shows the contact ring according to the third embodiment as part of a contact system in a second variant.
Figure 13C:
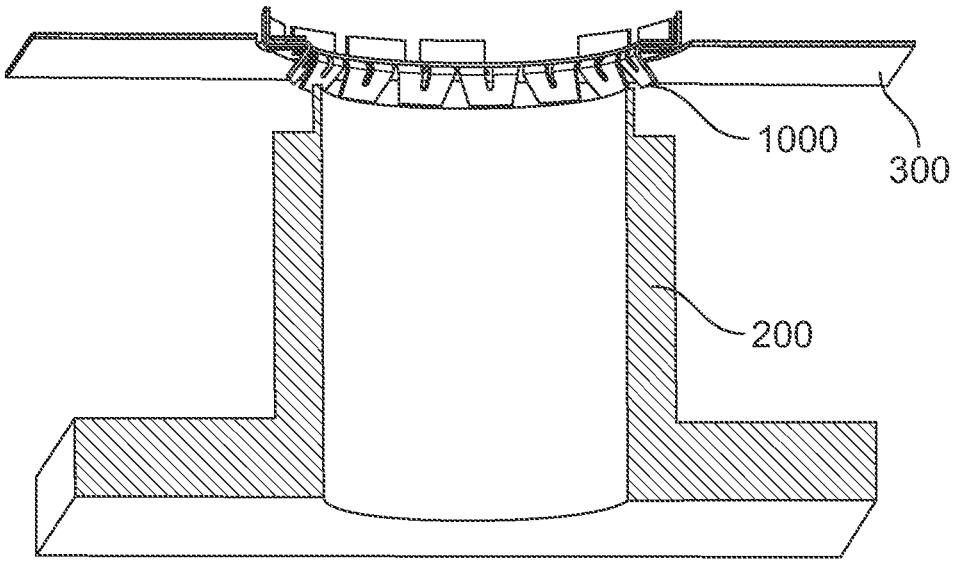
FIG. 13C shows the contact ring according to the third embodiment as part of a contact system in a third variant.
Figure 13D:
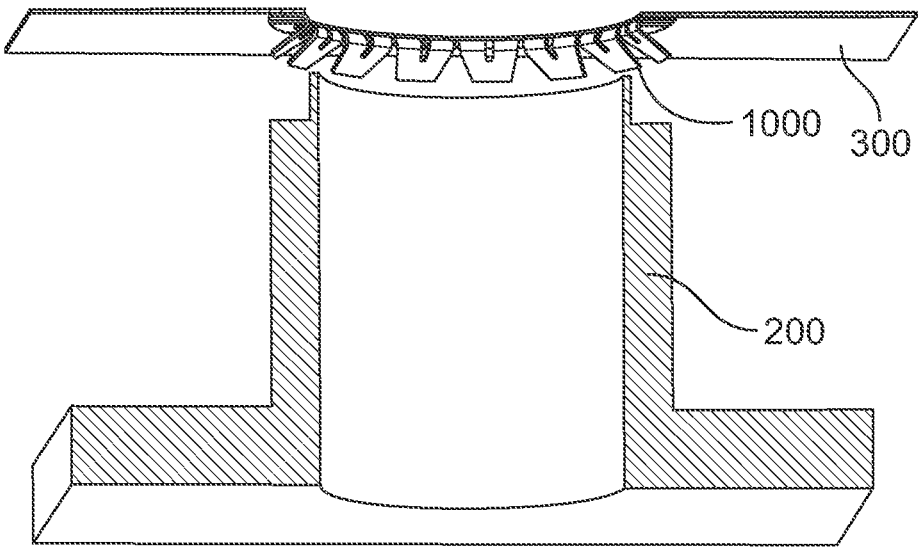
FIG. 13D shows the contact ring according to the third embodiment as part of a contact system in a fourth variant.

FIG. 10 shows a possible application of contact ring 1000 according to the third embodiment for connecting two contact elements 1 and 2. Due to its structure, contact ring 1000 is elastic in several directions of expansion. For example, the angle between outer 1009 and bent-over inner sections 1008 and therefore the expansion of contact ring 1000 out of the plane of the ring can be varied by moving contact elements 1 and 2 towards or away from one another. Likewise, the radius of contact ring 1000 can be varied by expanding or compressing the meander structure, thereby increasing or reducing the circumference of contact ring 1000. In the example of contact element 1 shown in FIG. 10, this property allows the radially elastic contact ring 1000 to be pulled over a latching step 1012 which is provided with a ramp 1014 on one side. In the target or installed position, contact ring 1000 rests on a retaining ring 1015 and is prevented from slipping off contact element 1 by latching step 1012.

The meander structure according to the third embodiment allows for a mechanically advantageous connection of the contact elements since they can be effectively decoupled and vibrations can thus be reduced. The configuration is also variable, and can be easily adapted to the given spatial conditions. For example, FIGS. 11A to 11F show a variation of contact ring 1000 according to the third embodiment which comprises an additional section of outer meanders 1016 pointing out of the plane of the ring and is therefore suitable for the attachment to cylindrical contact elements. The length and shape of the cutouts pointing inwardly and outwardly can then be varied and the spatial elastic properties of contact ring 1000 can thereby be adapted to the respective conditions. FIGS. 12A to 12D also show variations with attachment projections which can be connected to a contact element, for example, by welding.

As shown in FIGS. 13A to 13D, contact ring 1000 according to the third embodiment can also be used as part of a contact system for connecting a ground cylinder 200 and a shielding cylinder 300.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A contact ring for connecting a first electrically conductive contact element and a second electrically conductive contact element, comprising:

a strip of electrically conductive material defining a plurality of projections on at least one longitudinal side, the projections adapted to contact electrically conductive materials of the first and second contact elements for establishing an electrically conductive connection therebetween, the strip further defining a selectively mateable closure on each end thereof for closing the strip to form a circular ring.

2. The contact ring according to claim 1, wherein each projection defines a tapering end section for connecting to the contact elements.

3. The contact ring according to claim 1, wherein a portion of the ring extends in an axial direction for defining a cylindrical shape.

4. The contact ring according to claim 3, wherein the projections are defined on each side of the ring and extend in each axial direction.

5. The contact ring according to claim 4, wherein the projections extend radially outward from each side of the ring.

6. The contact ring according to claim 1, wherein the ring defines at least one flat annular surface.

7. The contact ring according to claim 6, wherein the projections include:

a plurality of first projections having sharpened edge sections defined on an inner side of the flat annular surface and extending in a first axial direction; and a plurality of second projections defined on an outer side of the flat annular surface and extending in a second axial direction opposite the first axial direction.

8. The contract ring according to claim 7, wherein a radial spacing between a plurality of adjacent first projections is greater than a radial spacing between a remainder of adjacent first projections.

9. The contact ring according to claim 6, wherein the projections include:

a plurality of first projections defining a toothing extending from an inner side of the flat annular surface in a first axial direction and a plurality of second projections defined on an outer side of the flat annular surface and extending in a second axial direction opposite the first axial direction.

10. The contact ring according to claim 6, wherein the strip includes sections alternatingly pointing inwardly and outwardly, the sections pointing inwardly are bent upwardly or downwardly from the plane of the ring and form the projections.

11. A contact system, comprising:

a ground cylinder;

a shielding cylinder press-fit with the ground cylinder; and a contact ring disposed between the ground cylinder and the shielding cylinder, the contact ring including a strip of electrically conductive material defining a plurality of projections on at least one longitudinal side, the projections electrically contacting the ground cylinder and the shielding cylinder for establishing an electrically conductive connection therebetween.

12. The contact system according to claim 11, wherein a portion of the ring extends in an axial direction for defining a cylindrical shape, the projections are defined on each side of the ring with a first portion of the projections extending radially outward and in a first axial direction from a first side of the ring, and a second portion of the projections extending radially outward and in a second axial direction, opposite the first axial direction, from the second side of the ring.

13. The contact system according to claim 11, wherein the ring defines at least one flat annular surface and the projections include:

a plurality of first projections having sharpened edge sections extending in a first axial direction from an inner side of the flat annular surface; and a plurality of second projections extending in a second axial direction opposite the first axial direction from an outer side of the flat annular surface.

14. The contact system according to claim 13, wherein the shielding cylinder includes a plurality of centering projections for centering the shielding cylinder with respect to the ground cylinder.

15. The contact system according to claim 14, wherein a radial spacing between a plurality of adjacent first projections is greater than a radial spacing between a remainder of adjacent first projections for receiving the plurality of centering projections therebetween.

16. The contact system according to claim 11, wherein the ring defines at least one flat annular surface and the projections include:

a plurality of first projections defining a toothing extending from an inner side of the flat annular surface in a first axial direction and a plurality of second projections extending from an outer side of the flat annular surface in a second axial direction opposite the first axial direction.

17. The contact system according to claim 11, wherein the strip includes sections alternatingly pointing inwardly and outwardly, the sections pointing inwardly are bent upwardly or downwardly from a plane of a flat annular surface of the ring and form the projections.

18. A contact ring for connecting a first electrically conductive contact element and a second electrically conductive contact element, comprising:

a circular ring of electrically conductive material defining a plurality of projections adapted to contact electrically conductive materials of the first and second contact elements for establishing an electrically conductive connection therebetween, a plurality of first projections of the plurality of projections each having an S-shaped cross section including a free end extending radially outward from a remainder of the projection relative to a center of the ring.

19. The contact ring according to claim 18, wherein:

the plurality of projections further include a plurality of second projections, each second projection defined by:

a sharpened first lateral edge section extending from an inner side of the ring in a first axial direction; and a second lateral edge section opposite the first lateral edge section and extending from the inner side of the ring in the first axial direction, the plurality of second projections each oriented at an angle relative to an axis extending in the first axial direction such that the sharpened first lateral edge section is positioned further radially outward than the second lateral edge section of the projection relative to the center of the ring; and the plurality of first projections extend in a second axial direction opposite the first axial direction from an outer side of the ring, the first projections each defining a generally flat side oriented about a common circle.

20. The contact ring according to claim 18, wherein the plurality projections include a plurality of first projections extending from a first side of the ring in a first axial direction and a plurality of second projections extending from a second side of the ring in a second axial direction, each of the first projections aligned with a corresponding one of the second projections in a radial direction relative to the center of the ring.

* * * * *